US005147988A

United States Patent [19]

Appleton

[11] Patent Number: 5,147,988

[45] Date of Patent: Sep. 15, 1992

[54] SWITCHING ELECTRICAL RECEPTACLE

[76] Inventor: Arthur I. Appleton, 22 Indian Creek Island, Miami Beach, Fla. 33154

[21] Appl. No.: 760,811

[22] Filed: Sep. 16, 1991

Related U.S. Application Data

[63] Continuation of Ser. No. 527,055, May 22, 1990.

[51] Int. Cl.[5] ..... H01R 33/96

[52] U.S. Cl. ..... 200/51.09; 200/260; 200/261; 200/253.1; 439/640; 439/646

[58] Field of Search ..... 200/51.02, 51.09, 51.11, 200/259, 260, 261, 253.1, 254; 439/137, 142, 144, 147, 482, 640, 646, 824, 834, 851, 881

[56] References Cited

U.S. PATENT DOCUMENTS

| | | | |
|---|---|---|---|
| 3,235,682 | 2/1966 | Papworth | 200/51.09 |
| 3,599,167 | 8/1971 | Adrian et al. | 200/51.09 X |
| 3,618,065 | 11/1971 | Trip et al. | 200/51.09 X |
| 3,644,871 | 2/1972 | Lafont | 200/51.09 X |
| 3,843,853 | 10/1974 | Panek et al. | 200/321 X |
| 3,960,428 | 6/1976 | Naus et al. | 200/51.09 X |
| 4,044,208 | 8/1977 | McDonald et al. | 200/51.09 X |
| 4,090,761 | 5/1978 | Souville et al. | 200/51.09 X |
| 4,304,457 | 12/1981 | Lissau | 439/851 |

FOREIGN PATENT DOCUMENTS

| | | | |
|---|---|---|---|
| 1129193 | 1/1957 | France | 200/51.09 |

*Primary Examiner*—Henry J. Recla
*Assistant Examiner*—Glenn T. Barrett
*Attorney, Agent, or Firm*—Jones, Day, Reavis & Pogue

[57] ABSTRACT

A switching electrical receptacle includes a fixed set of female contacts mounted to be connected to electric power lines. A housing supports a plurality of sliding contacts of substantially cylindrical symmetry disposed parallel to an axis. The housing can be slid axially into and out of electrical contact with the female contacts to make or break a circuit. The sliding contacts are in permanent sliding contact with another set of female contacts that are connected to load terminals that are adapted to receive an electric plug. Each sliding contact is split along its axis and is spring-loaded from within to exert radial forces that assure good electrical connections between the sliding contact and each set of female contacts. Seals are readily installed in the housing to make the receptacle explosion-proof and also appropriate for outdoor use.

3 Claims, 4 Drawing Sheets

SWITCHING ELECTRICAL RECEPTACLE

This is a continuation-in-part of copending application Ser. No. 07/527,055 filed on May 22, 1990.

BACKGROUND OF THE INVENTION

This invention is related to electrical receptacles for use with electrical plugs. In particular, it is an improved electrical receptacle that can be switched at the receptacle.

Electrical receptacles for currents of fifteen amperes or more typically have contacts for three, four or five wires. Such receptacles may injure an operator and may damage the receptacle if they are connected or disconnected to the electric power system under load. For these reasons, it is conventional to provide some form of switch with the receptacle, often interlocked with the receptacle, to insure that the plug is not removed from or inserted into the receptacle under load. The switch is often a safety switch or relay that is installed in a switchbox that serves as a mount for the receptacle. In the alternative, the receptacle may be combined with a circuit breaker. Either of these alternatives increases the cost of installing a receptacle over the cost of the receptacle itself.

It would be useful to have a self-contained receptacle that could be switched to cut off electricity to a plug before the plug is removed from or inserted into the receptacle. Such a receptacle could be operated as a stand-alone device or it could be combined with an interlock as an additional assurance that the plug is not inserted into or removed from the receptacle under load. It would also be useful to have a switching electrical receptacle that would meet requirements for rating for explosion-proof service. Such a switching receptacle could be smaller than a combination safety switch and receptacle, and would therefore be cheaper to manufacture and easier to install. It could also more easily be made explosion-proof because its contacts open and close in a relatively small volume within the receptacle.

SUMMARY OF THE INVENTION

It is an object of the present invention to provide a better electrical receptacle for currents of fifteen amperes or more per phase.

It is a further object of the present invention to provide a switching electrical receptacle that can be switched manually at the receptacle.

It is a further object of the present invention to provide a switching electrical receptacle that can be switched at the receptacle by a manually-operated over-center linkage.

It is a further object of the present invention to provide a switching electrical receptacle that can be switched electrically, pneumatically or hydraulically at the receptacle.

It is a further object of the present invention to provide an electrical receptacle that can be switched on and off by axial motion of a contact carrier.

It is a further object of the present invention to provide an explosion-proof switching electrical receptacle.

Other objects will become apparent in the course of a detailed description of the invention.

A switching electrical receptacle includes a fixed set of female contacts mounted to be connected to electric power lines. A housing supports a plurality of sliding contacts of substantially cylindrical symmetry disposed parallel to an axis. The housing can be slid axially into and out of electrical contact with the female contacts to make or break a circuit. The sliding contacts are in permanent sliding contact with another set of female contacts that are connected to load terminals that are adapted to receive an electric plug. Each sliding contact is split along its axis and is spring-loaded from within to exert radial forces that assure good electrical connections between the sliding contact and each set of female contacts. Seals are readily installed in the housing to make the receptacle explosion-proof and also appropriate for outdoor use.

DETAILED DESCRIPTION OF THE INVENTION

Figure 1:
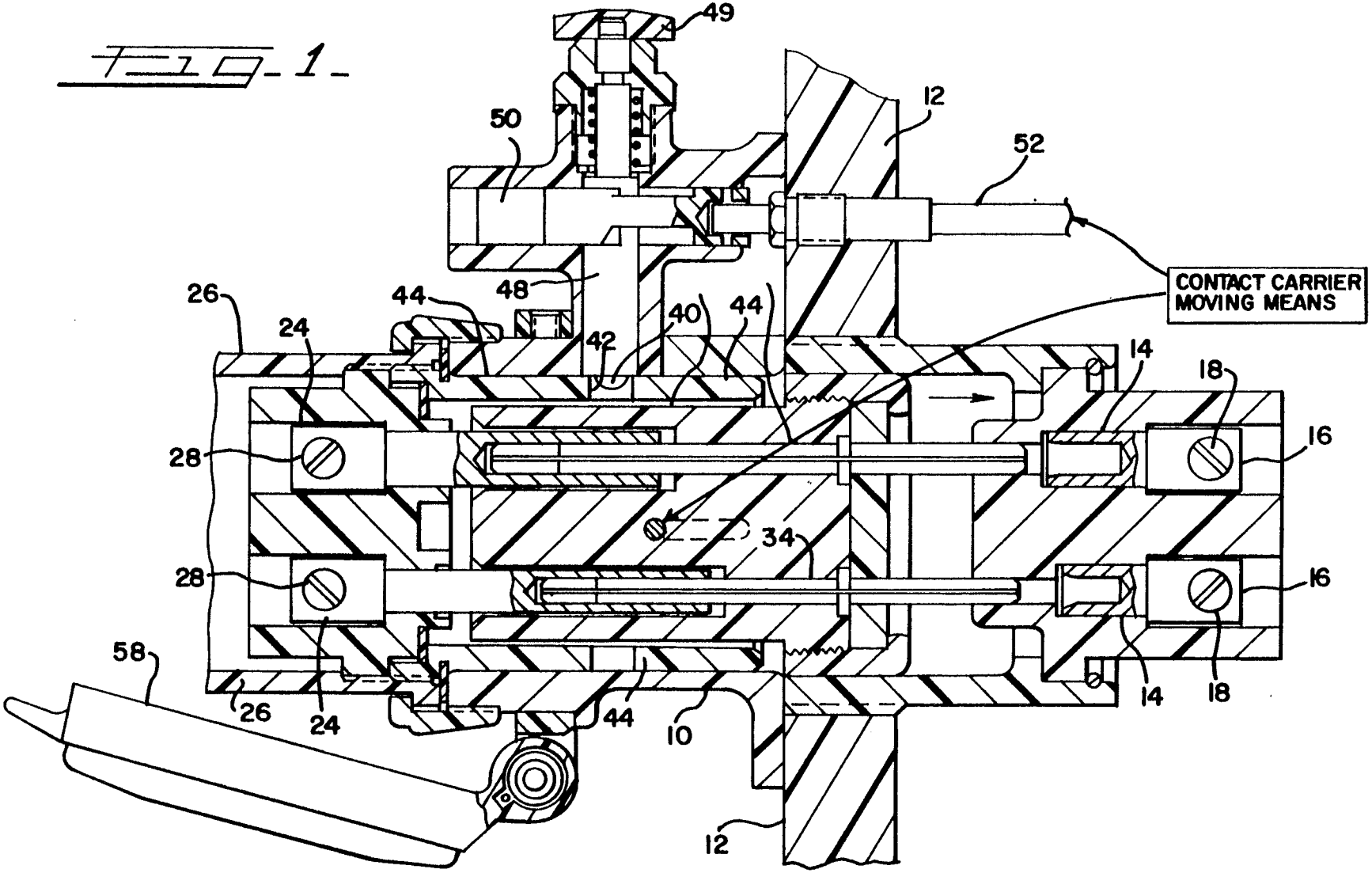
FIG. 1 is a central sectional side view of the apparatus of the present invention with a switch in an open position.
Figure 2:
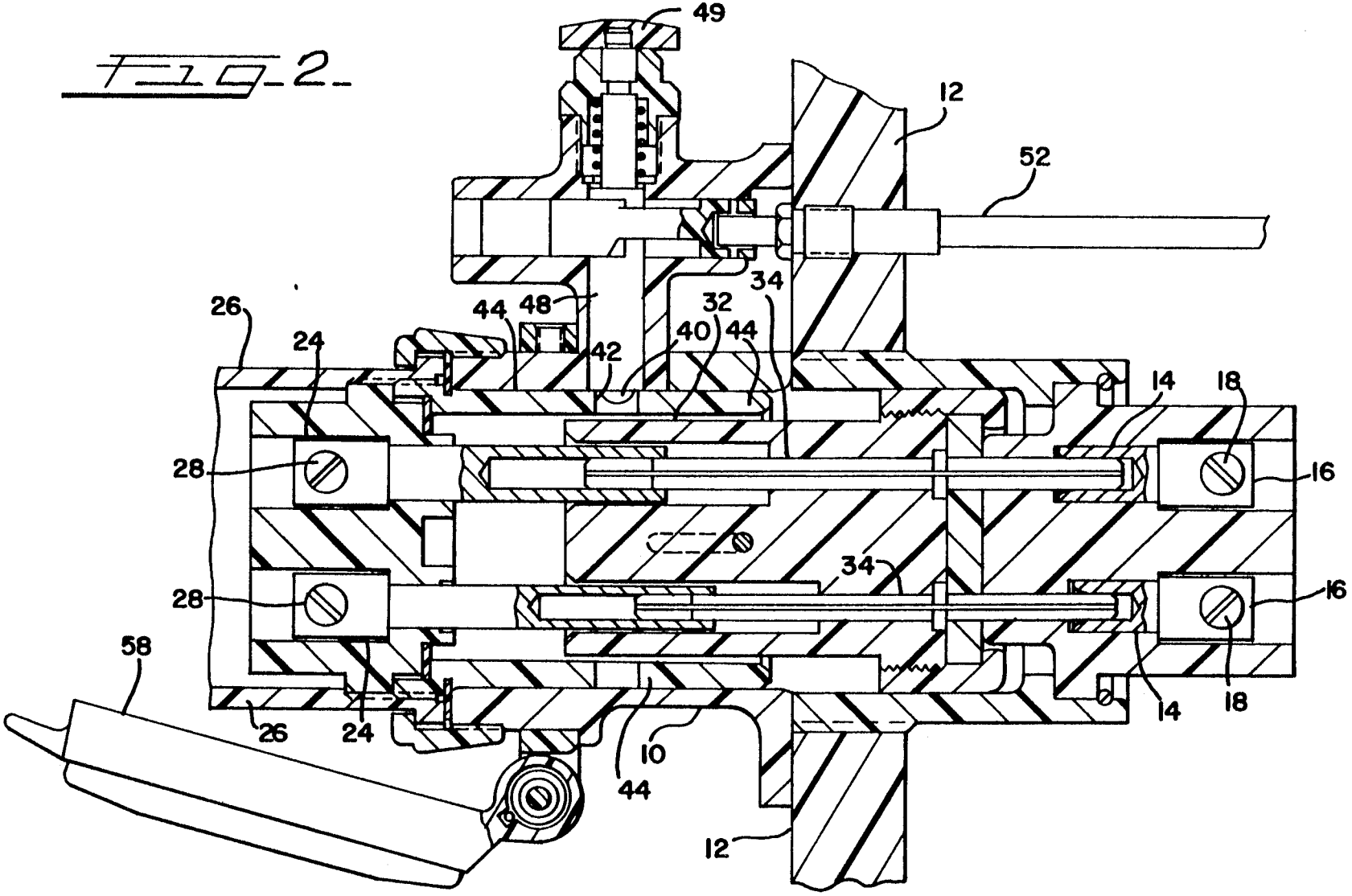
FIG. 2 is a central sectional side view of the apparatus of the present invention with the switch in a closed position.

FIG. 1 is a central sectional side view of an apparatus for the practice of the present invention with a switch in an open position, and FIG. 2 is a central sectional side view of the apparatus with the switch in a closed position. In FIGS. 1 and 2, a receptacle 10 is affixed to a wall 12. The receptacle 10 contains a plurality of female terminals 14 that are connected to wire terminals 16. Wires, which are not shown here, are inserted into the wire terminals 16 to supply electric power to the receptacle 10. Each wire terminal 16 has a screw 18 that can be tightened on an inserted wire to establish a secure electrical and mechanical contact between such a wire and each wire terminal 16.

In use, it is desired to make connections between the female terminals 14 of the receptacle 10 and a corresponding set of female terminals 24 that are part of a plug 26. The female terminals 24 are also adapted to be connected by a set of screws 28 to wires that are not shown here. A contact carrier 32 carries a sliding contact 34 for each associated pair of wire terminals 14 and 24. FIG. 2 shows the contact carrier 32 in a position where each of the female terminals 14 is connected to a corresponding one of the female terminals 24 by the sliding contact 34 that moves with the contact carrier 32. This is the "on" position for the switching receptacle 10. FIG. 1 shows the opposite situation, with the contact carrier 32 moved to a position where contact is interrupted between the female terminals 14 and 24. A circuit breaker handle or disconnect switch, not shown in FIGS. 1 and 2, is used to reciprocate contact carrier 32 axially by means known in the art, such as a conventional over-center mechanism. Detent 40 at one end of rod 48 is inserted in a hole 42 in the casing 44 of the plug 26 in order to prevent removal of the plug. Thus, in order to remove plug 26, detent 40 must first be disengaged by raising rod 48 by means of handle 49. In so doing, it is intended that the operator will remember to reciprocate contact carrier to the "off" position by means of the circuit breaker handle, thereby interrupting the electrical circuit when electric power is connected so that the plug 26 cannot be removed from the receptacle 10 under load. Because such a memory aid is not foolproof, however, an interlock comprising cam 50 and rod 52 may be added to switching receptacle 10. Rod 52 and, therefore, cam 50 are reciprocated by means of the circuit breaker handle. Cam 50 and detent 48 are respectively configured so that detent 40 can be raised only when cam 50 is moved out of a blocking position by rod 52.

In FIGS. 1 and 2, the plug 26 is in the receptacle 10, holding a hinged cap 58 in an open position. If the plug 26 is removed from the receptacle 10, the hinged cap 58 closes to protect the female terminals 24 from dirt, moisture and the like.

Figure 3:
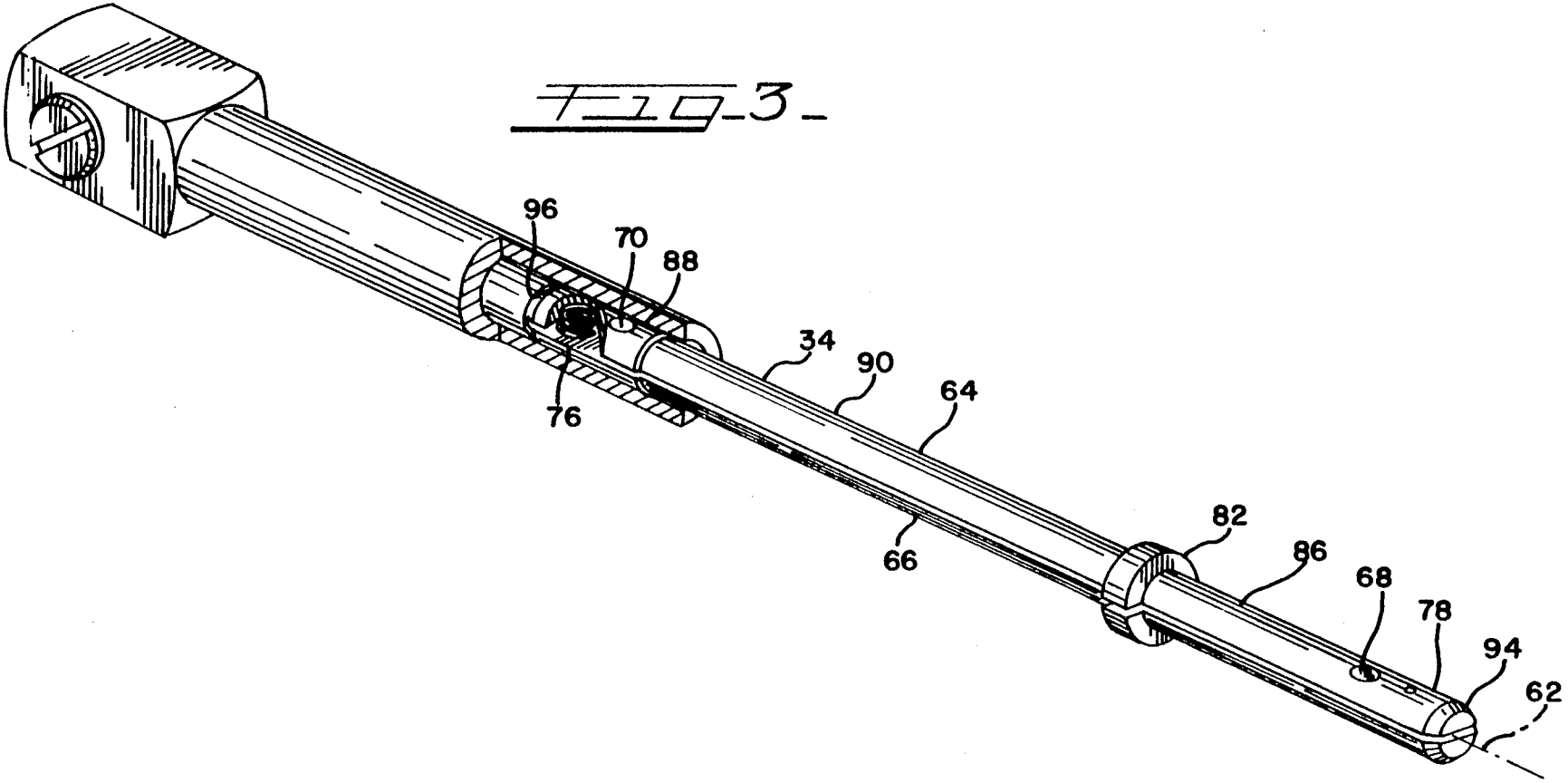
FIG. 3 is a central sectional side view of a sliding contact for the practice of the present invention.

FIG. 3 is a sectional side view of one of the sliding contacts 34 of FIGS. 1 and 2. In FIG. 3, the sliding contact 34 exhibits cylindrical symmetry about an axis 62. A first half 64 is attached to a second half 66 by rivets 68 and 70. The rivets 68 and 70 are sized to permit the first half 64 to move radially with respect to the second half 66, but are headed to keep the first half 64 and second half 66 together. It should be evident that other means such as screws threaded into tapped holes or nuts and bolts could equally as well be used to keep the first half 64 and second half 66 together while permitting them to move radially with respect to each other. In the alternative, the halves 64 and 66 could be held together by retaining rings inserted in grooves so that the rings would not contact the female terminals 14 and 24. The rivets 68 and 70 are preferred because they provide guides for relative radial motion between the halves 64 and 66.

Two springs 76 and 78 that are placed between the halves 64 and 66 exert forces on the halves 64 and 66 that will tend to keep them apart and will thus make good electrical connections between the sliding contact 34 and the female terminals 14 and 24. A shoulder 82 has a diameter that is greater than the diameter of the contact regions 86 and 88. A relieved region 90 is given a diameter slightly less, of the order of 0.001–0.010", to reduce sliding friction upon insertion of the sliding contact 34 into a female terminal 14 or its removal from the terminal 14. Chambers 94 and 96 at opposite ends of the sliding contact 34 aid in connecting the plug 26 to the receptacle 10 and in moving the sliding contact 34 into the female terminal 14. The construction described here insures good electrical contact without requiring the machining of especially close tolerances, and it does not use the elasticity of the brass or similar material of the sliding contact 34.

Figure 4:
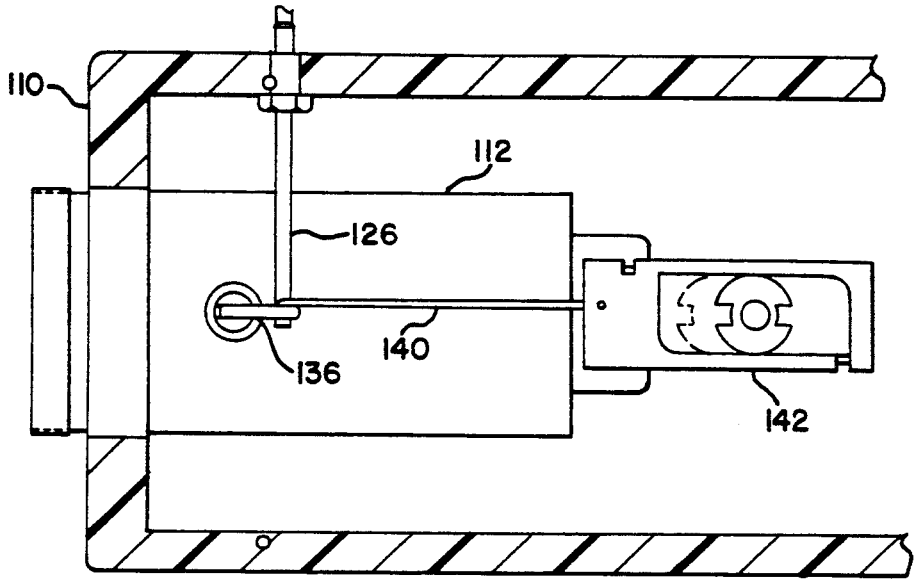
FIG. 4 is a top view of an apparatus for the present invention including an actuator.
Figure 5:
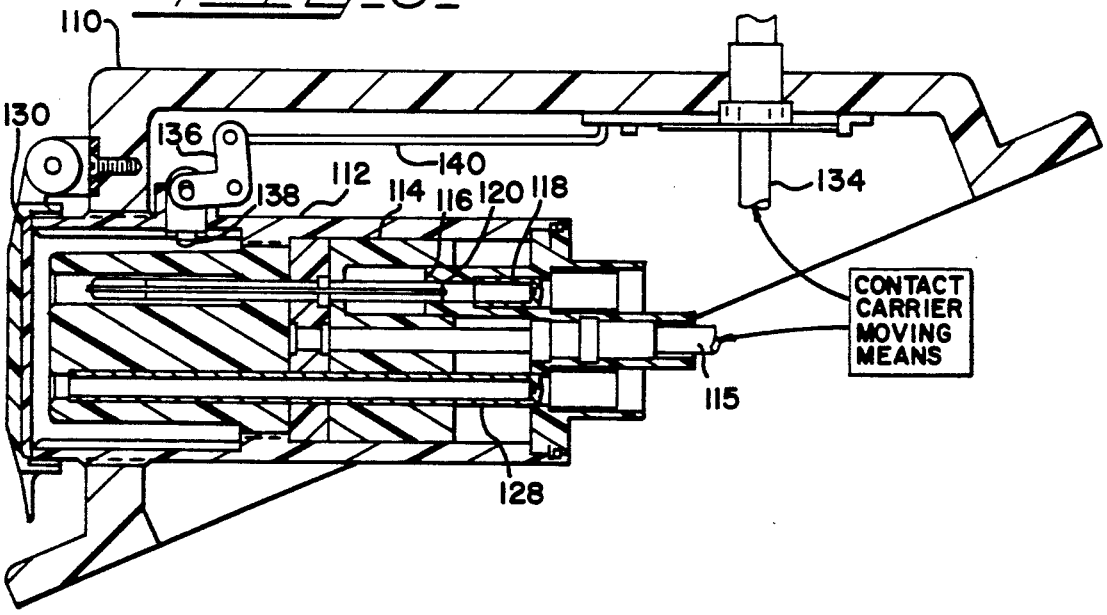
FIG. 5 is a central sectional side view of the apparatus of FIG. 4.

FIG. 4 is a top view of an apparatus constituting a separate embodiment for the practice of the present invention including an actuator for the switch, and FIG. 5 is a central sectional side view of the apparatus of FIG. 4. In FIGS. 4 and 5, a frame 110, which may be part of a wall or of a switch box, provides support for a housing 112 which in turn supports a contact carrier 114 bearing control rod 115. A sliding contact 116 bearing male terminal 120 is shown in an interrupted position in which it does not make contact with a corresponding female terminal 118. Control rod 115 of contact carrier 114 is reciprocated axially by means of rod 134 connected to a circuit breaker handle. Actuating means (not shown) connecting rod 134 and control rod 115 may be manual, such as an over-center mechanism whose combination of brackets and springs translate the rotational motion of rod 134 into axial movement of control rod 115 and contact carrier 114. However, the actuating means may likewise be hydraulic, pneumatic, or electrical-mechanical in nature, as is known in the art, with suitable results.

The receptacle of FIG. 5 also differs from that of FIG. 1 in having a ground contact 128 that is not switched but that makes continuous contact with a plug (not shown) that may be inserted into the receptacle of FIG. 5.

In order to insert the plug into the receptacle, the operator must lift a cover 130 and rotate rod 136, thereby raising detent 138 by means of linkage 136. At the same item, linkage 136 and circuit breaker rod 134 are connected by means of rod 140 and cam plate 142. Rotation of rod 134 to place contact carrier 114 in the "on" position will lock cam plate 142 so that actuating rod 126 cannot be rotated to raise detent 138. Thus, the contact carrier must be moved by means of the circuit breaker handle to interrupt the electrical circuit before the detent can be raised in order to insert or remove the plug.

The embodiments of the invention described above are intended to describe the best mode for the practice of the invention, and should be taken as exemplary and not as limiting. The scope of the invention is that of the appended claims and their equivalents.

I claim:

1. A switching electrical receptacle, comprising:

a. a substantially cylindrical electrical contact, the contact being split and internally-spring loaded;

b. a frame supporting the contact;

c. a contact carrier receiving the contact and capable of moving with the contact along an axis, the contact carrier sliding with respect to the frame;

d. a first fixed terminal permanently secured to the frame and connectible to an electrical power line, the first fixed terminal aligned with the axis;

e. a second fixed terminal connectible to an electrical plug, and secured to the frame and aligned with the axis during switching operation of the receptacle; and f. means for moving the contact carrier axially so that the contact remains in electrical contact with the second fixed terminal at all times, exerting radial forces thereon, while making and breaking electrical contact with the first fixed terminal, exerting radial forces on the first fixed terminal when in electrical contact therewith.

2. The apparatus of claim 1, comprising in addition means for preventing complete insertion of a plug into the receptacle when the contact is touching the fist terminal.

3. A switching electrical receptacle adapted to receive an electrical plug and to make and brake electrical contact with the plug, the receptacle comprising:

a. a plurality of female electrical contacts disposed substantially parallel to each other, each of the female contacts disposed to be connected to an electrical power line;

b. a housing connected to the female electrical contacts and insulated electrically from the female electrical contacts;

c. a contact holder mounted in sliding engagement with the housing and disposed to slide in a direction parallel to the female contacts; and d. a plurality of sliding contacts mounted in the contact holder and disposed to slide into and out of electrical contact with the female contacts at a first end, each of the sliding contacts including a male portion at a second end that is opposite the first end, the male portions projecting to make contact with the plug, each contact being split and internally spring-loaded to exert radial forces on the respective female electrical contact and plug when engaged therewith.

* * * * *